US012089696B1

(12) United States Patent
Bar

(10) Patent No.: US 12,089,696 B1
(45) Date of Patent: Sep. 17, 2024

(54) EASY ENTRY SANDAL

(71) Applicant: ORTHOFEET, INC., Norwood, NJ (US)

(72) Inventor: Aharon Bar, Fort Lee, NJ (US)

(73) Assignee: ORTHOFEET, INC, Norwood, NJ (US)

( * ) Notice: Subject to any disclaimer, the term of this patent is extended or adjusted under 35 U.S.C. 154(b) by 0 days.

(21) Appl. No.: 18/634,836

(22) Filed: Apr. 12, 2024

(51) Int. Cl.
*A43B 3/12* (2006.01)
*A43B 23/04* (2006.01)

(52) U.S. Cl.
CPC ..... *A43B 3/126* (2013.01); *A43B 3/12* (2013.01); *A43B 23/047* (2013.01)

(58) Field of Classification Search
CPC ..... A43B 3/12; A43B 3/122; A43B 3/126; A43B 23/0047
USPC ..... 36/11.5
See application file for complete search history.

(56) References Cited

U.S. PATENT DOCUMENTS

| | | | | |
|---|---|---|---|---|
| 2,205,577 | A * | 6/1940 | Roberts | A43B 3/126 36/51 |
| 3,570,147 | A * | 3/1971 | Chiu | A43B 3/24 36/11.5 |
| 3,707,784 | A * | 1/1973 | Stafford | A43B 13/38 36/11.5 |
| 7,823,299 | B1 * | 11/2010 | Brigham | A43B 3/24 36/11.5 |
| 2003/0009909 | A1 * | 1/2003 | Chen | A43B 13/14 36/141 |
| 2008/0155855 | A1 * | 7/2008 | Klavano | A43B 3/122 36/51 |
| 2008/0276492 | A1 * | 11/2008 | Burnett | A43C 11/22 36/51 |
| 2021/0378356 | A1 * | 12/2021 | Cheney | A43B 3/12 |

* cited by examiner

*Primary Examiner* — Marie D Bays
(74) *Attorney, Agent, or Firm* — Smith Tempel Blaha LLC; Gregory Scott Smith

(57) ABSTRACT

A sandal comprising an upper and a heel strap made of at least five members, including three firm members and two elastic members. The heel strap is allowed to pivot relative to the upper, wherein a rear part of the heel strap is allowed to further pivot relative to the anterior heel strap members. The sandal includes elastic members that are stretched while the heel strap pivots downward under a downward force on the heel strap while a foot slides into the sandal. The elastic members force the heel strap to pivot upward when the downward force is released.

21 Claims, 15 Drawing Sheets

EASY ENTRY SANDAL

FIELD

The field of the present disclosure and the related embodiments relate to the field of sandals, and more particularly, to enabling easy entry of a foot into a sandal.

BACKGROUND

A significant number of users have difficulties bending down to help put on shoes with closed heel design. However, when putting a sandal on, most sandals require bending down to adjust the sandal's straps. There is thus a widely recognized need for a sandal that enables a user to put it on and take it off without the need for bending down and using the user's hands.

A variety of easy-entry shoes are known in art, however, the methods described in such prior art technologies do not provide good solutions for putting on and taking off a sandal without using the user's hands, or do not describe hands-free sandals that provide a comfortable fit, and therefore, there is a need in the art for a sandal resolving the above deficiencies, as well as a sandal that is easier and inexpensive to produce.

Unless otherwise defined, all technical and scientific terms used herein have the same meaning as commonly understood by one of ordinary skill in the relevant art. The materials, methods, and examples provided herein are illustrative only and not intended to be limiting. Except to the extent necessary or inherent in the processes themselves, no particular order to the steps or stages of methods and processes described in this disclosure, including the figures, is intended or implied. In many cases the order of process steps may vary without changing the purpose or effect of the methods described.

BRIEF DESCRIPTION OF THE DRAWINGS

Various embodiments are described herein, by way of example only, with reference to the accompanying drawings. With specific reference now to the drawings in detail, it is stressed that the particulars shown are by way of example and for purposes of illustrative discussion of the preferred embodiments only and are presented to provide what is believed to be the most useful and readily understood description of the principles and conceptual aspects of the embodiment. In this regard, no attempt is made to show structural details of the embodiments in more detail than is necessary for a fundamental understanding of the subject matter, the description taken with the drawings making apparent to those skilled in the art how the several forms and structures may be embodied in practice.

In the drawings.

DESCRIPTION OF EMBODIMENTS

Figure 1A:
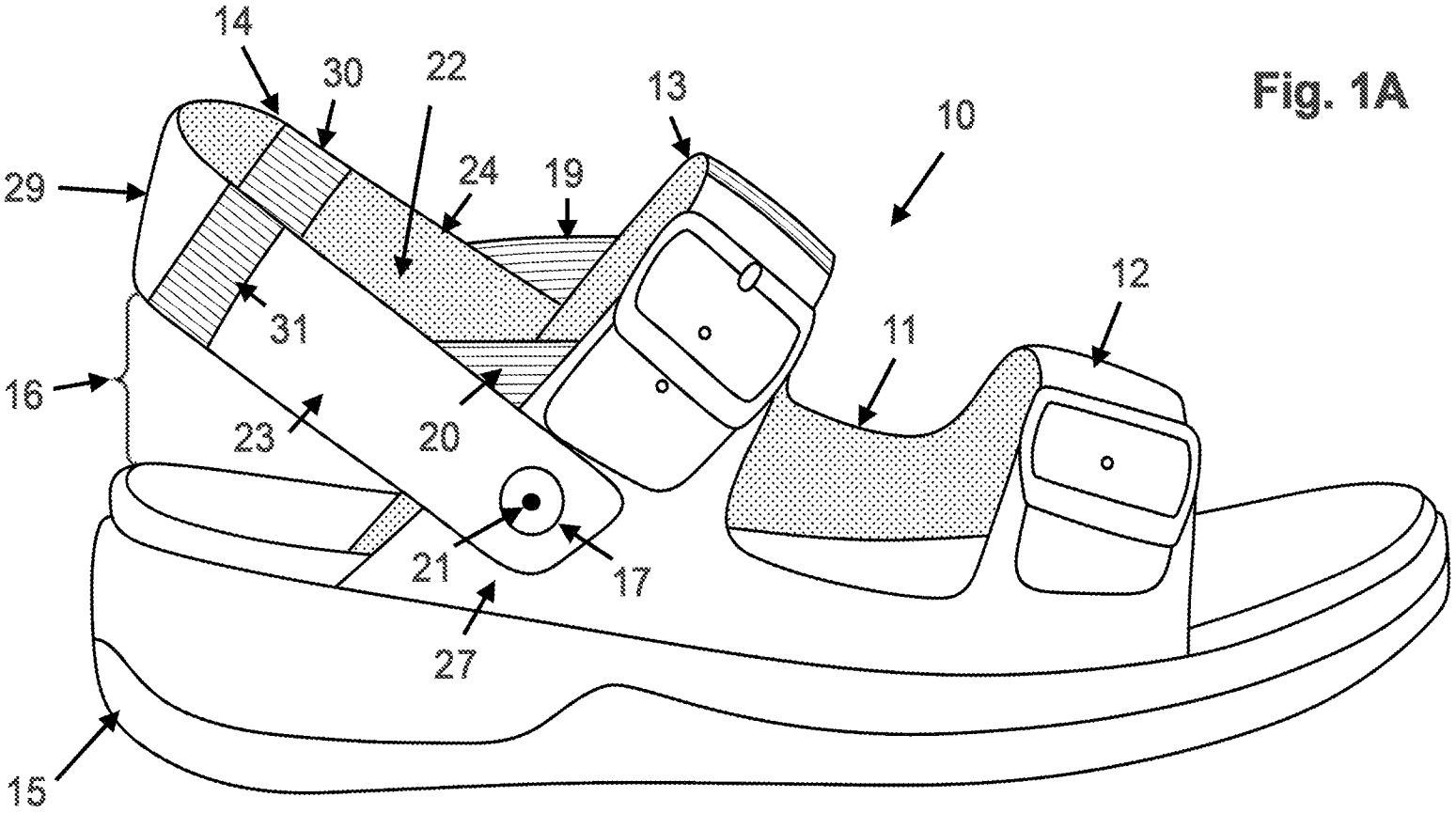
FIG. 1A is a simplified illustration of a side view of an exemplary embodiment of an easy entry sandal incorporating one or more aspects of the present invention.

The principles and structure according to some embodiments of an easy entry sandal provide hands-free entry of the user's foot, may be better understood with reference to the drawings and accompanying description.

Before explaining at least one embodiment in detail, it is to be understood that the embodiments are not limited in its application to the details of construction and the arrangement of the components set forth in the following description or illustrated in the drawings. Other embodiments may be practiced or carried out in various ways. Also, it is to be understood that the phraseology and terminology employed herein is for the purpose of description and should not be regarded as limiting.

In this document, an element of a drawing that is not described within the scope of the drawing and is labeled with a numeral that has been described in a previous drawing has the same use and description as in the previous drawings. Similarly, an element that is identified in the text by a numeral that does not appear in the drawing described by the text, has the same use and description as in the previous drawings where it was described.

The drawings in this document may not be to any scale. Different drawings may use different scales and different scales can be used even within the same drawing, for example different scales for different views of the same object or different scales for the two adjacent objects.

The terms 'a' or "an', as used herein, are defined as one or more than one. The term plurality, as used herein, is defined as two or more than two. The term another, as used herein, is defined as at least a second or more. The terms including and/or having, as used herein, are defined as comprising.

The phrases "at least one" "one or more" and "and/or" are open-ended expressions that are both conjunctive and disjunctive in operation. For example, each of the expressions "at least one of A, B and C, "at least one of A, B, or C, "one or more of A, B, and C. "one or more of A, B, or C and "A, B, and/or C" means A alone, B alone, C alone, A and B together, A and C together, B and C together, or A, B and C together. The terms "a" or "an entity" refers to one or more of that entity. As such, the terms "a" (or "an"), "one or more" and "at least one" can be used interchangeably herein.

It is also to be noted that the terms 'comprising', 'including', 'containing', 'characterized by', and 'having' are all inclusive, open-ended, does not exclude additional, unrecited elements or method steps, and can be used interchangeably. Particularly, these terms may imply the inclusion of a stated integer or step or group of integers or steps but not the exclusion of any other integer or step or group of integers or steps. This definition also applies to variations on the term "comprising" such as "comprise" and "comprises".

Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment", and similar language throughout this specification may, but do not necessarily, all refer to the same embodiment.

The term coupled, as used herein, is defined as connected, although not necessarily directly, and not necessarily mechanically. The term 'flexible' or 'elastic' may refer to a material of a part of a sandal that may be stretched and/or compressed by exerting a force and may assume the original shape when the force is removed. The terms 'stiff' 'firm' or 'rigid' may refer to a material of a part of a sandal that is not 'flexible' or 'elastic' and may thus retain its shape under the force that stretches and/or compresses the 'flexible' or 'elastic' material or part of the sandal. The term "longitudinal plane" refers to the perpendicular plane to the ground, which divides the sandal into left and right. The term "anterior" refers to the general forward direction from a heel area of the sandal toward the front part of the sandal. The term "posterior" refers to the general rearward direction from the front part of the sandal toward the heel area of the sandal.

Figure 1B:
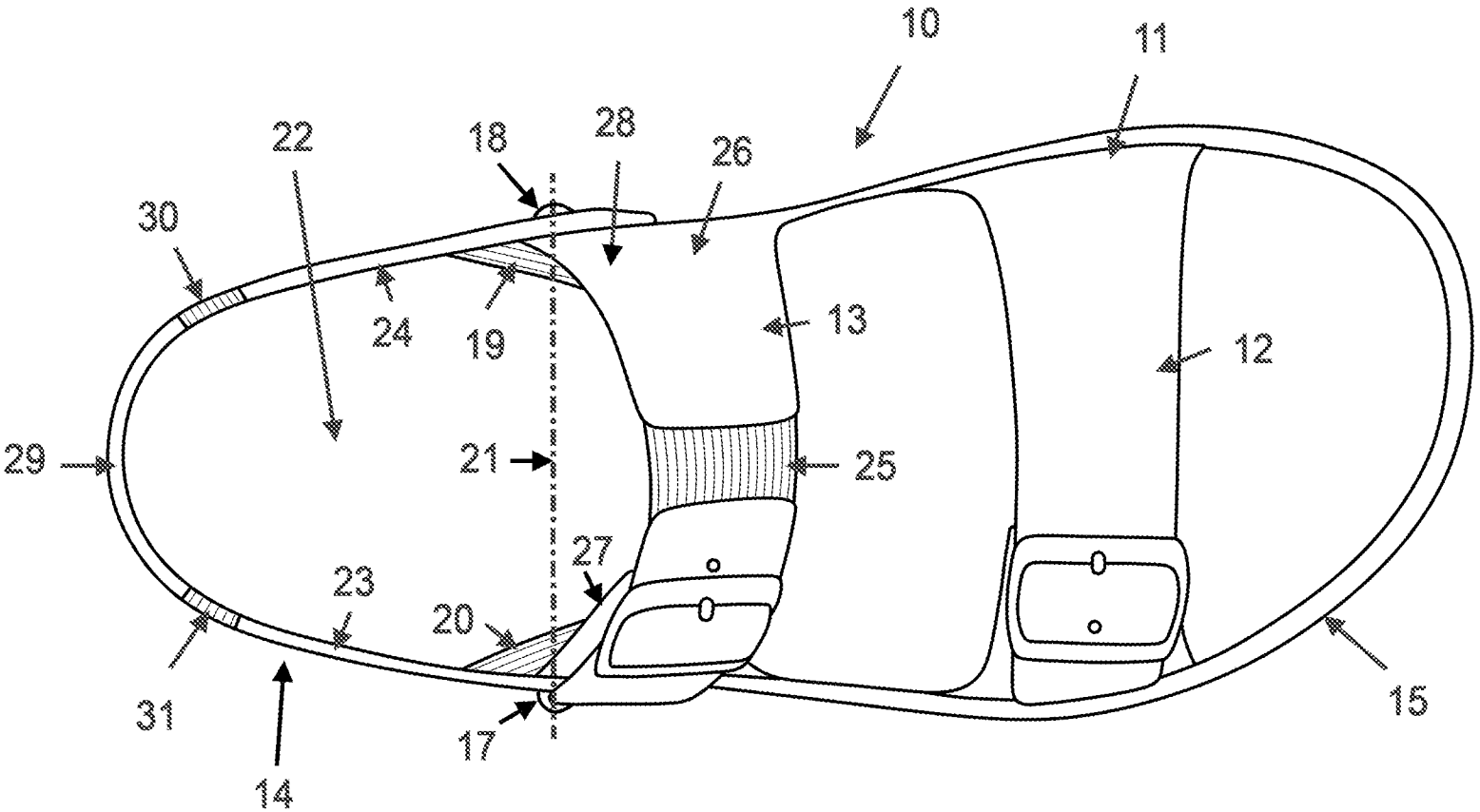
FIG. 1B is a simplified illustration of a top view of the sandal of FIG. 1A.

Reference is now made to FIG. 1A, which is a simplified illustration of a lateral view of a sandal 10, and to FIG. 1B, which is a simplified illustration of a top view of sandal 10, according to one embodiment.

It is appreciated that sandal 10 is adapted for a right foot of a human user. A left sandal adapted for a left foot of a human user may be like sandal 10 of FIG. 1A and FIG. 1B, wherein left foot sandals are generally symmetrical or mirror images of the right foot sandals.

As shown in FIG. 1A and FIG. 1B sandal 10 may include upper 11 and sole 15. FIG. 1A and FIG. 1B show one possible form of an upper 11 having two straps in the front part of sandal 10, such as front strap 12, instep strap 13, and heel strap 14 in the rear part of the sandal. Another form of upper is shown further below.

According to FIGS. 1A and 1B, heel strap 14 is shown in its upward position, forming void 16 between a lower edge of heel strap 14 and a rear part of sole 15. Heel strap 14 may be coupled to upper 11 with pivoting articles, such as hinge 17 on the lateral side and hinge 18 on the medial side. Another form of pivoting article is shown further below. The hinges 17 and 18, as illustrated, may be constructed from a variety of techniques including, but not limited to, a pin, a rivet, a screw, a snap, a button, etc. The upper 11, or the part of the upper 11 proximate to the hinges 17 and 18 may be constructed from a rigid or substantially firm or stiff material that operates to prevent or retard the distortion of the upper 11 and/or the area of the upper 11 surrounding hinges 17 and 18 when a force is applied to the top of heel strap 14. Heel strap 14 may be additionally connected to upper 11 with medial anterior elastic member 19, and lateral anterior elastic member 20.

FIG. 1B depicts a frontal axis 21, which is a line that runs from the medial side of the sandal to the lateral side of the sandal through hinge 17 on the lateral side and hinge 18 on the medial side of sandal 10. According to one embodiment, heel strap 14 may pivot downward and upward relative to the upper 11 and sole 15 generally around frontal axis 21, or generally along the longitudinal plane of the sandal.

Rear strap 14 and upper 11 may define a sandal opening 22 through which a foot may be inserted into while putting on the sandal. According to one embodiment shown in FIG. 1B, sandal opening 22 may be defined by instep strap 13 and heel strap 14. Straps 12 and 13 may include adjustment means, such as a buckles, snaps, slides or hook and loop systems, as non-limiting examples, for securing the foot inside the sandal.

As shown in FIG. 1B, a lateral strap member 23 may be attached to the lateral part of upper 11 via lateral hinge 17, and a medial strap member 24 may be attached to the medial part of upper 11 via medial hinge 18.

Additionally, according to another embodiment of this disclosure, depicted in FIG. 1A and FIG. 1B, front part 13 of sandal upper 11 is allowed to stretch. According to another embodiment, front part 13 comprises elastic member 25, which may be stretched when putting the sandal on, thus increasing the size of sandal opening 22. Examples of elastic member 25 may include a rubber strap, Lycra, or Spandex as non-limiting examples.

As indicated in FIG. 1A and FIG. 1B, sandal article 10 may include anterior medial elastic member 19, which may be attached on one end to medial strap member 24, and on its other end, to medial member 26 of strap 13. Sandal 10 may also include anterior lateral elastic member 20, which may be attached on one end to lateral strap member 23, and on its other end, to lateral member 27 of strap 13. Members 19 and 20 may be fabricated from a variety of materials including a rubber strap, Lycra, or Spandex as non-limiting examples.

Further, according to one embodiment of the existing disclosure, the lateral aspect of the upper 11 surrounding hinge 17, in the general upper area 27, may be made from a firm material to prevent the lateral area 27, surrounding hinge 17, from substantially changing its structure under forces applied by a foot while entering sandal 10.

Similarly, the medial aspect of upper 11 surrounding hinge 18, in the general upper area 28, may be made from a firm material to prevent the medial part of upper 11, surrounding hinge 18, from substantially changing its structure under forces applied by a foot while entering sandal 10.

Figure 2:
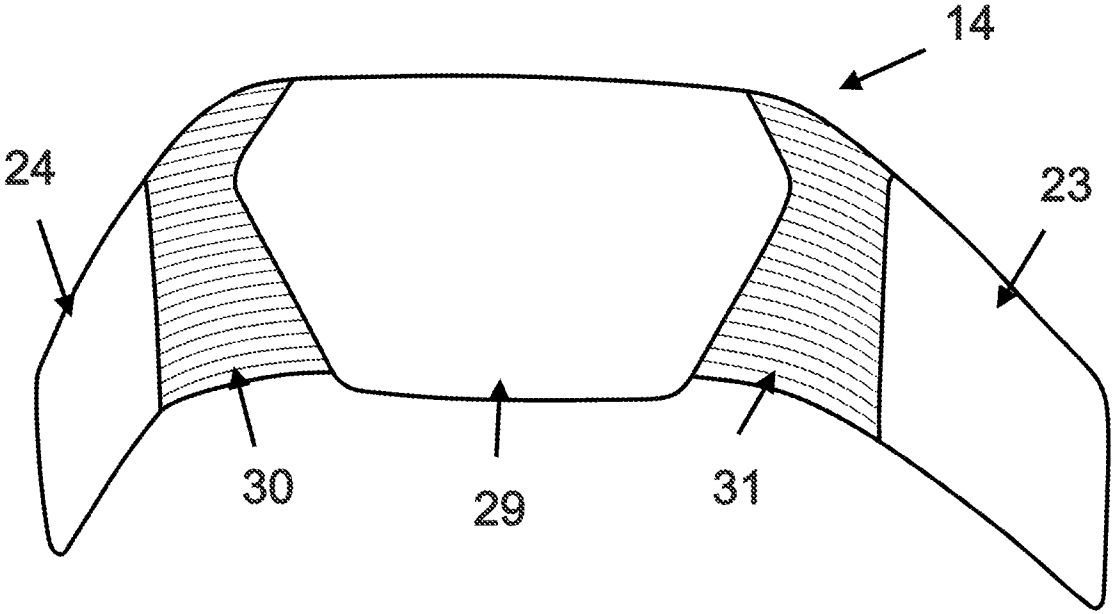
FIG. 2 is a simplified illustration of a rear view of heel strap suitable for use in various embodiments of an easy entry sandal.

Reference is now made to FIG. 2, which is a simplified illustration of a rear view of heel strap 14 according to one embodiment.

As an option, the simplified illustration of FIG. 2 may be viewed in the context of the details of the previous figures. Of course, however, the simplified illustration of FIG. 2 may be viewed in the context of any desired environment. Further, the aforementioned definitions may equally apply to the description below.

Heel strap 14 may include a rear strap member 29, a medial strap member 24, a medial elastic strap member 30, a lateral strap member 23, and a lateral elastic strap member 31, wherein rear strap member 29 may be attached to medial strap member 24 via medial elastic strap member 30, and wherein rear strap member 29 may be attached to lateral strap member 23 via lateral elastic strap member 31.

Rear strap member 29, medial strap member 24 and lateral strap member 23 may be made from a firm material, which may prevent a substantial change to their structural shape under forces applied on the heel strap when a foot is inserted into sandal 10.

Heel strap 14 may comprise elastic straps 30 and 31, that may make heel strap 14 pliable, allowing it to conform to the contours of a heel of a foot.

Figure 3A:
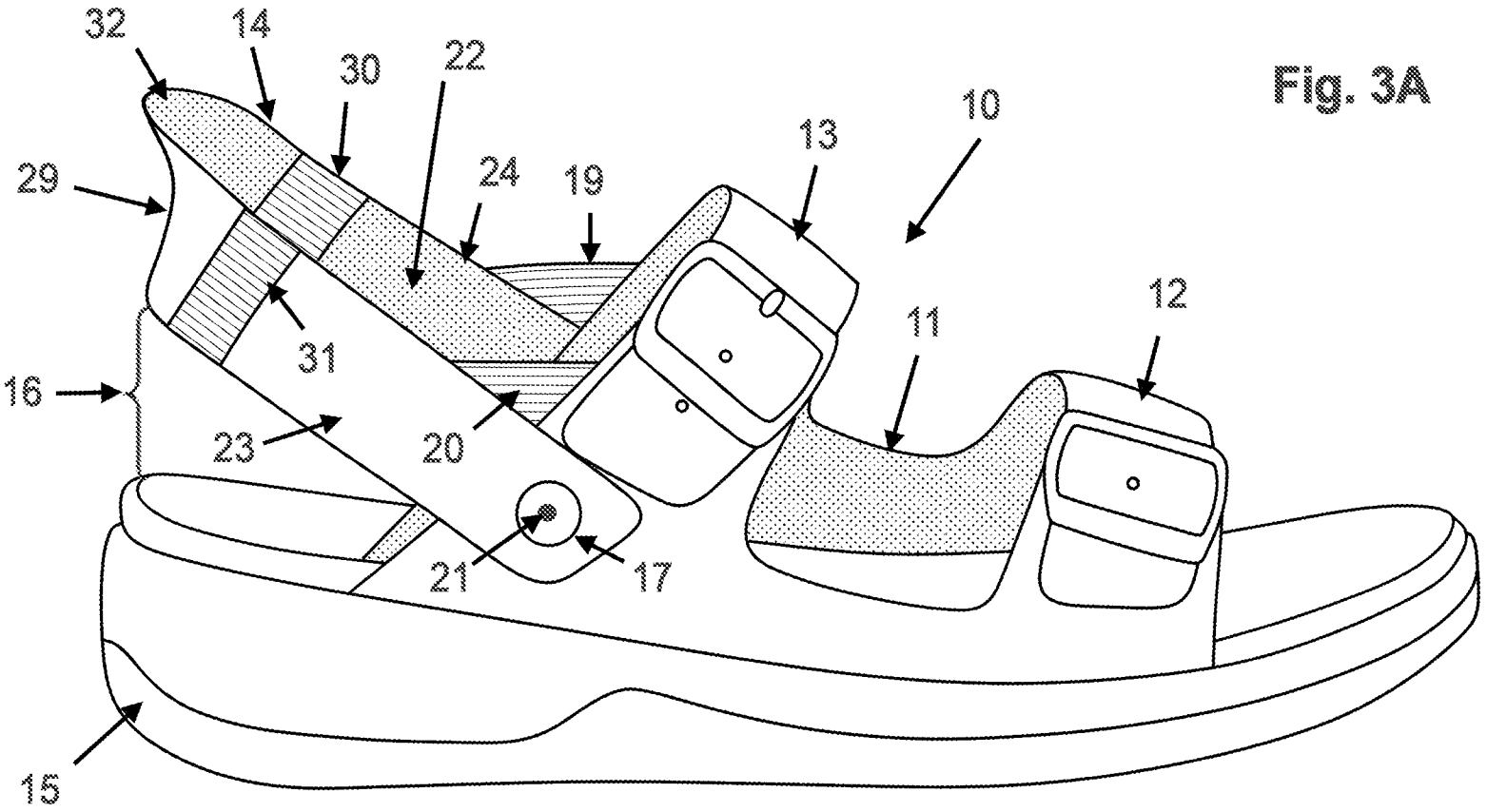
FIG. 3A is a simplified illustration of a side view of another exemplary embodiment of an easy entry sandal having a curved heel strap.

Reference is now made to FIG. 3A, which is a simplified illustration of a side view of another embodiment of sandal 10 according to one embodiment.

As an option, the simplified illustration of FIG. 3A may be viewed in the context of the details of the previous figures. Of course, however, the simplified illustration of FIG. 3 may be viewed in the context of any desired environment. Further, the aforementioned definitions may equally apply to the description below.

As shown in FIG. 3A, rear strap member 29 may be curved diagonally upward and backward, providing a sliding surface 32 at the inner side of rear strap member 29. This sliding surface 32 is thus flanged outward from the opening 22 in a yawning fashion to provide a surface over which the heel can more easily slide into opening 22 of sandal 10.

Figure 3B:
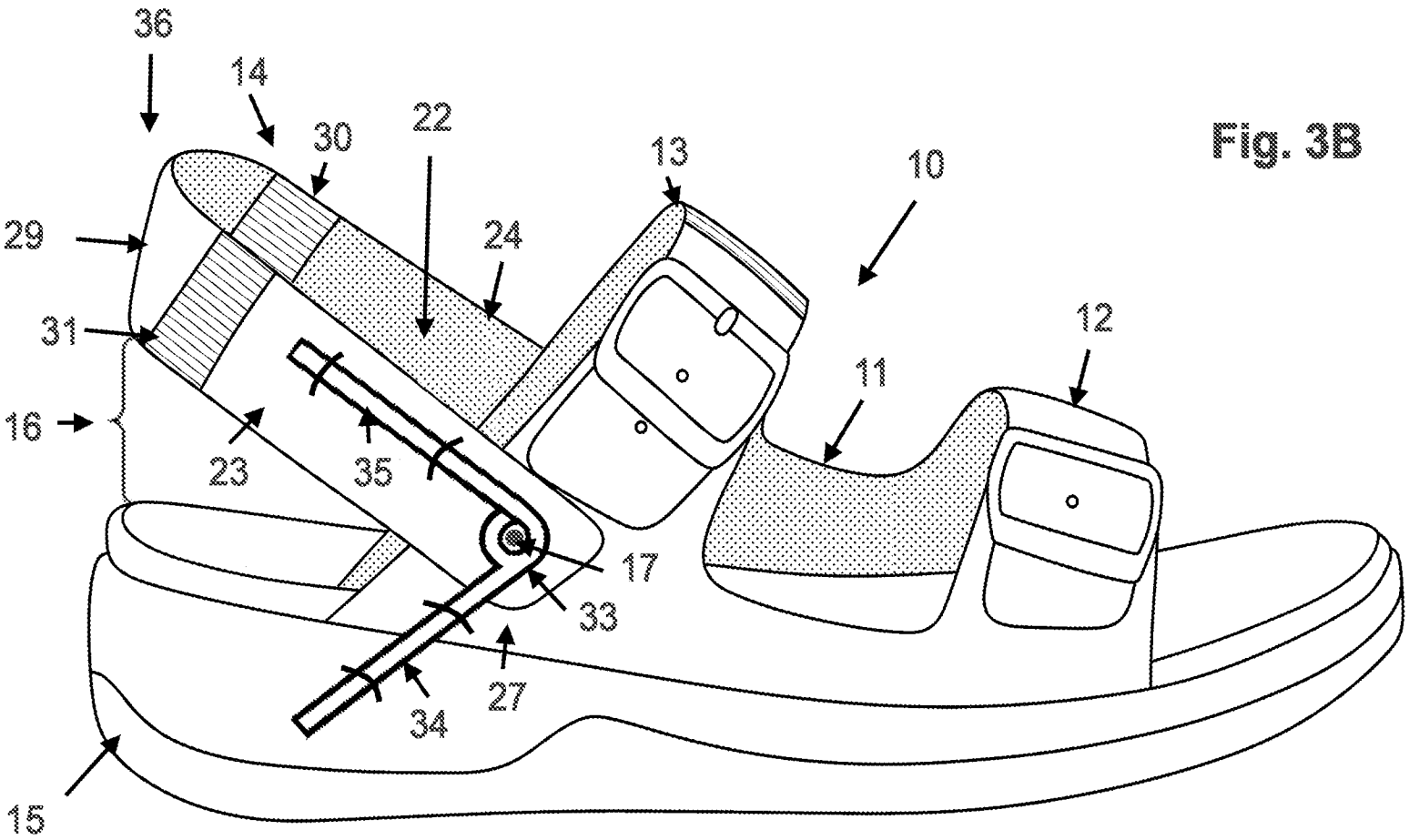
FIG. 3B is a simplified illustration of a side view of yet another exemplary embodiment of an easy entry sandal.

Reference is now made to FIG. 3B, which is a simplified illustration of a side view of another embodiment of sandal 10 according to one embodiment.

As an option, the simplified illustration of FIG. 3B may be viewed in the context of the details of the previous figures. Of course, however, the simplified illustration of FIG. 3A may be viewed in the context of any desired environment. Further, the aforementioned definitions may equally apply to the description below.

According to one embodiment described in FIG. 3B, sandal 10 comprises a lateral torsion spring 33, having lever 35, which is attached to lateral strap member 23, and wherein its other lever 34 is attached to either the lateral side of upper 27, to the lateral side of the sole 15, or to both the lateral side of upper 11 and the lateral side of sole 15. Similarly, sandal 10 comprises a medial torsion spring, which is attached on one end to the medial strap member 24, and on its other end, to either the medial side of the upper, to the medial side of the sole 15, or to both the medial side of the upper and the medial side of the sole (not shown).

According to one embodiment, by applying a downward force 36 on heel strap 14, both the medial strap member 24 and the lateral strap member 23 are allowed to pivot downward relative to upper 11, and wherein rear strap member 29 is allowed to pivot downward and backward relative to both medial strap member 24 and lateral strap member 23.

Figure 4A:
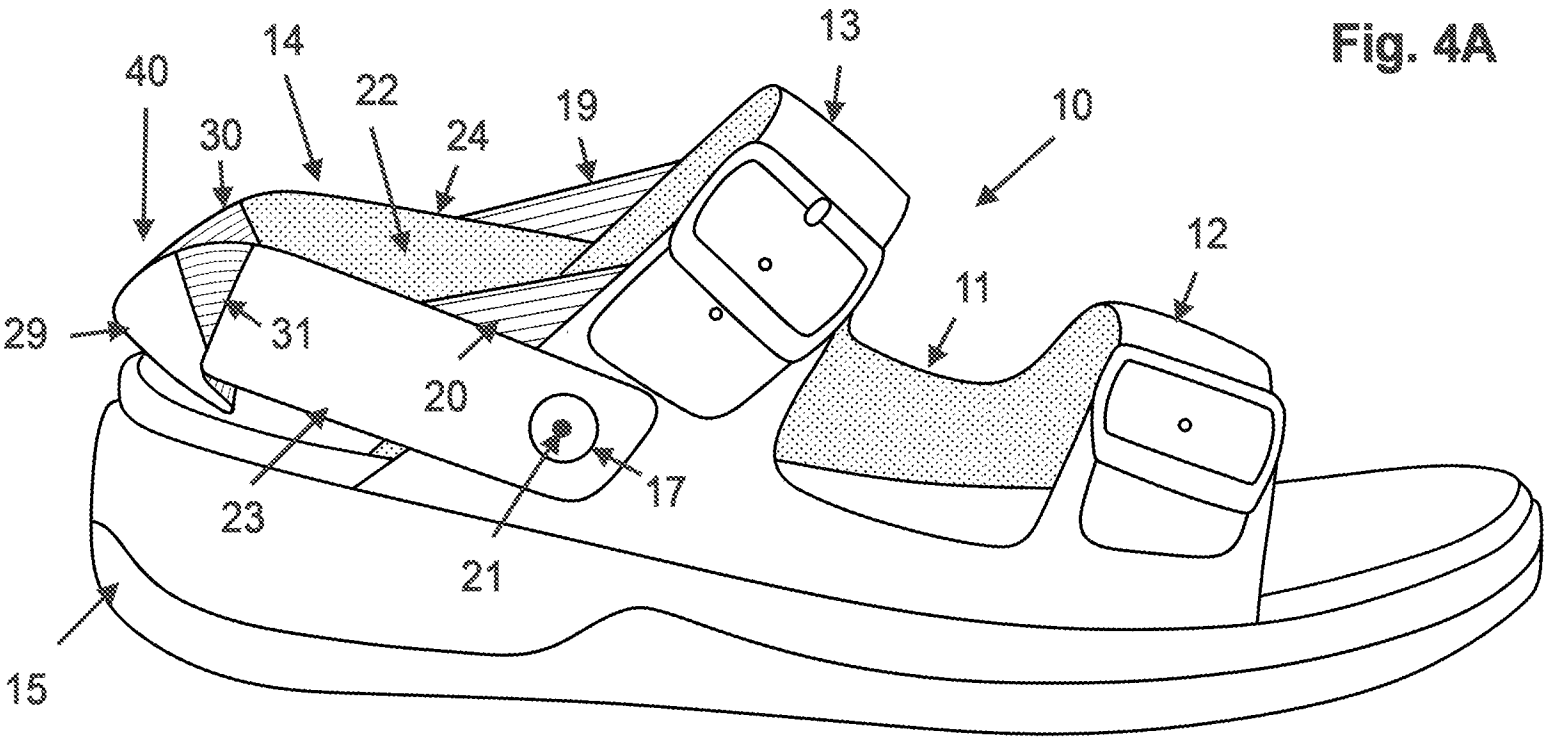
FIG. 4A is a simplified illustration of a lateral view of an exemplary easy entry sandal when a downward force is applied on the heel strap while a foot is entering the sandal.

Reference is now made to FIG. 4A, which is a simplified illustration of a lateral view of sandal 10 according to this disclosure, showing a possible lower position of heel strap 14 when a downward force is applied on heel strap 14 while a foot is entering the sandal.

As an option, the simplified illustration of FIG. 4A may be viewed in the context of the details of the previous figures. Of course, however, the simplified illustration of FIG. 4A may be viewed in the context of any desired environment. Further, the aforementioned definitions may equally apply to the description below.

As shown in FIG. 4A, when a downward force 40 is applied on heel strap 14, which occurs while a foot is entering the sandal, both medial strap member 24 and lateral strap member 23 may pivot downward relative to upper 11 around frontal axis 21, or generally along the longitudinal plane of the sandal. Additionally, rear strap member 29 may pivot further downward and backward relative to both medial strap member 24 and lateral strap member 23, thus increasing the size of sandal opening 22 compared to the sandal opening 22 described in FIG. 3A, where heel strap 14 is in its upward position. It is appreciated that medial elastic strap member 30 and lateral elastic strap member 31, which may enable rear strap member 29 to pivot relative to medial strap member 24 and relative to lateral strap member 23 may further increase the size of sandal opening 22 compared to the sandal opening 22 in FIG. 3A, for allowing easy donning of the sandal without the need of using hands.

As depicted in FIG. 4A, when heel strap 14 is pivoting downward, anterior medial elastic member 19 and anterior lateral elastic member 20 may be stretched, while lateral elastic strap member 31 and medial elastic strap member 30 may be bent and stretched, thus storing elastic potential energy in said four elastic members. It is appreciated that elastic straps 30 and 31 may control the position of rear part 29 of heel strap 14.

It is appreciated that while rear strap member 29 pivots relative to members 23 and 24 it may also rotate outward, or backward. It is appreciated that sliding surface 32, shown in FIG. 3A, may be instrumental in helping rotate rear strap member 29 outward, or backward, which increases the size of sandal opening 22. If a forward rotation of the rear portion of heel strap were to occur, it might result in moving the rear part of the heel strap towards the center of the sandal, which might reduce the size of the sandal opening.

Once a foot has entered the sandal and force 40 is no longer pressing on the heel strap, stretched anterior lateral elastic member 20 operates to assert a drawing force or bias on lateral strap member 23 to cause it to pivot upward along axis 21, and stretched anterior medial elastic member 19 operates to assert a drawing force or bias on medial strap member 24 to cause it to pivot upward. Further, both stretched lateral elastic strap member 31 and stretched medial elastic strap member 30 assert a drawing force or bias on rear strap member 29 to cause it to pivot upward and forward and to be biased against the posterior surface of the heel of a foot.

Figure 4B:
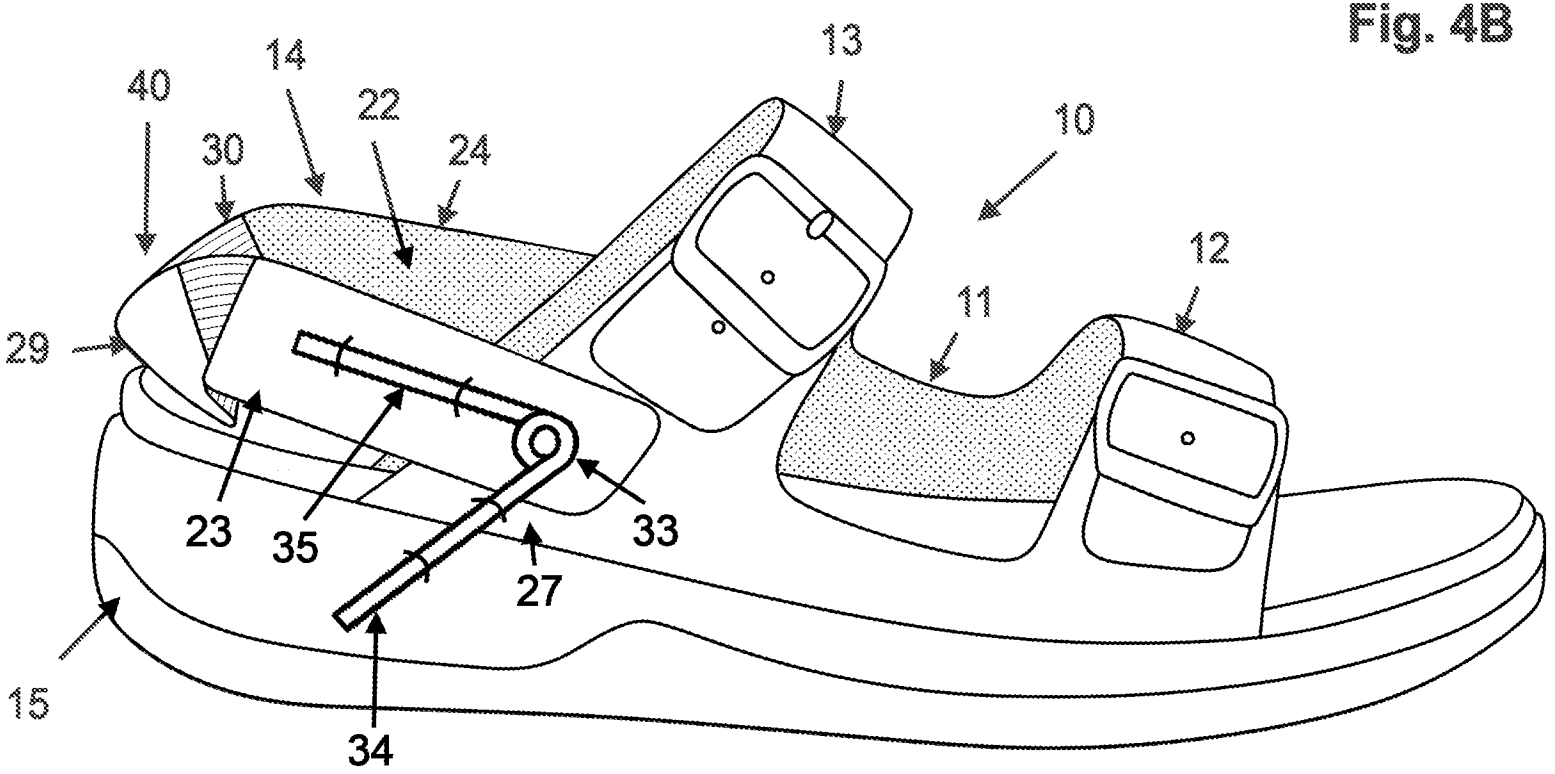
FIG. 4B, is a simplified illustration of a lateral view of an easy entry sandal according to another embodiment of this disclosure when a downward force is applied on heel strap while a foot is entering the sandal.

Reference is now made to FIG. 4B, which is a simplified illustration of a lateral view of sandal 10 according to another embodiment of this disclosure, showing a possible lower position of heel strap 14 when a downward force 40 is applied on heel strap 14 while a foot is entering the sandal.

As an option, the simplified illustration of FIG. 4B may be viewed in the context of the details of the previous figures. Of course, however, the simplified illustration of FIG. 4B may be viewed in the context of any desired environment. Further, the aforementioned definitions may equally apply to the description below.

As shown in FIG. 4B, when heel strap 14 is pivoted downward due to a downward force 40, both medial torsion spring (not shown) and lateral torsion spring 33 store potential energy, while lateral elastic strap member 31 and medial elastic strap member 30 are bent and stretched, storing as well potential energy.

Once downward force 40 is removed, lateral torsion spring 33 draws lateral strap member 23 to pivot upward, medial torsion spring draws the medial strap member 23 to pivot upward, and both stretched lateral elastic strap member 31 and stretched medial elastic strap member 30 draw the rear strap member to pivot upward and forward.

Figure 5A:
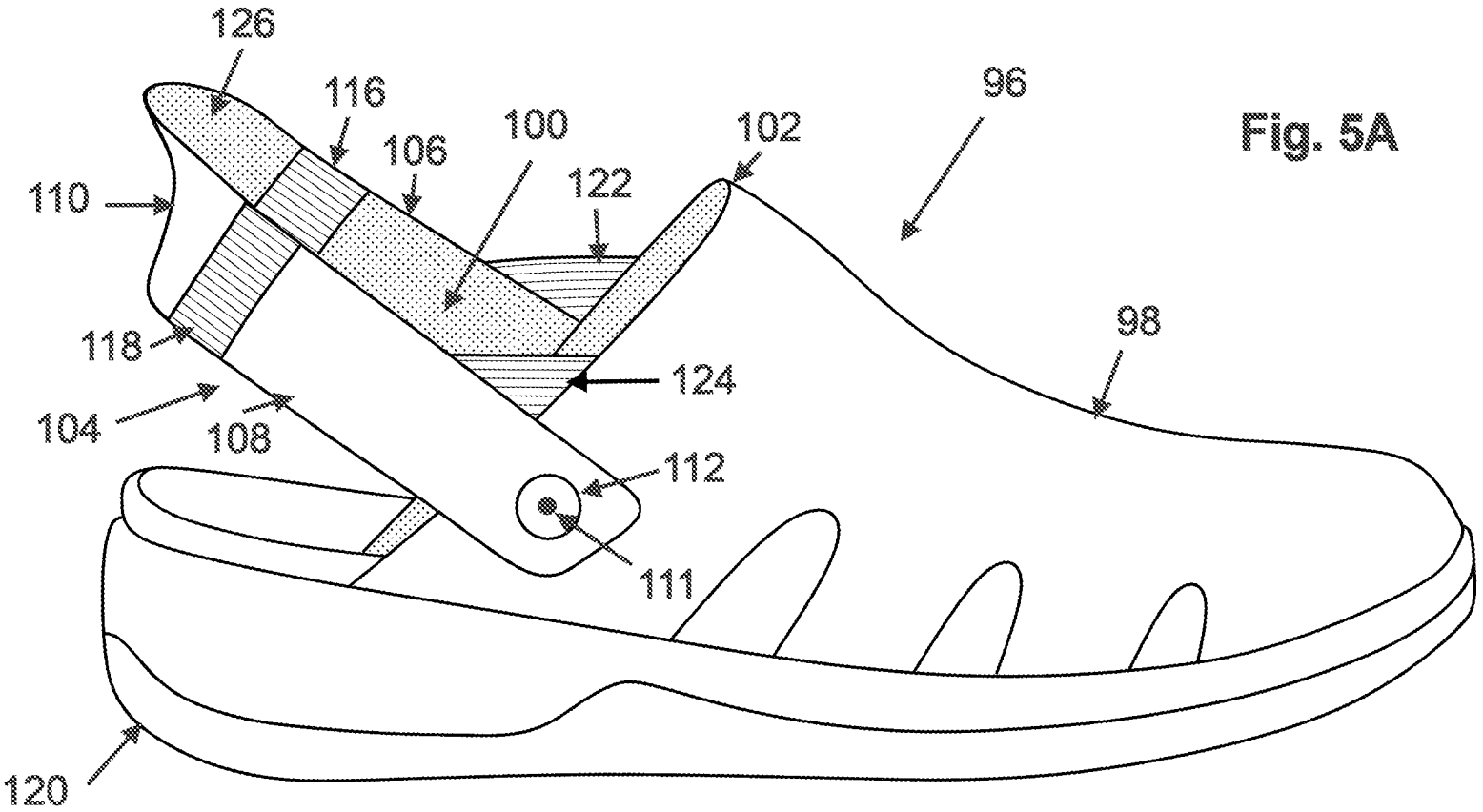
FIG. 5A is a simplified illustration of a side view of a closed-toe east entry sandal.
Figure 5B:
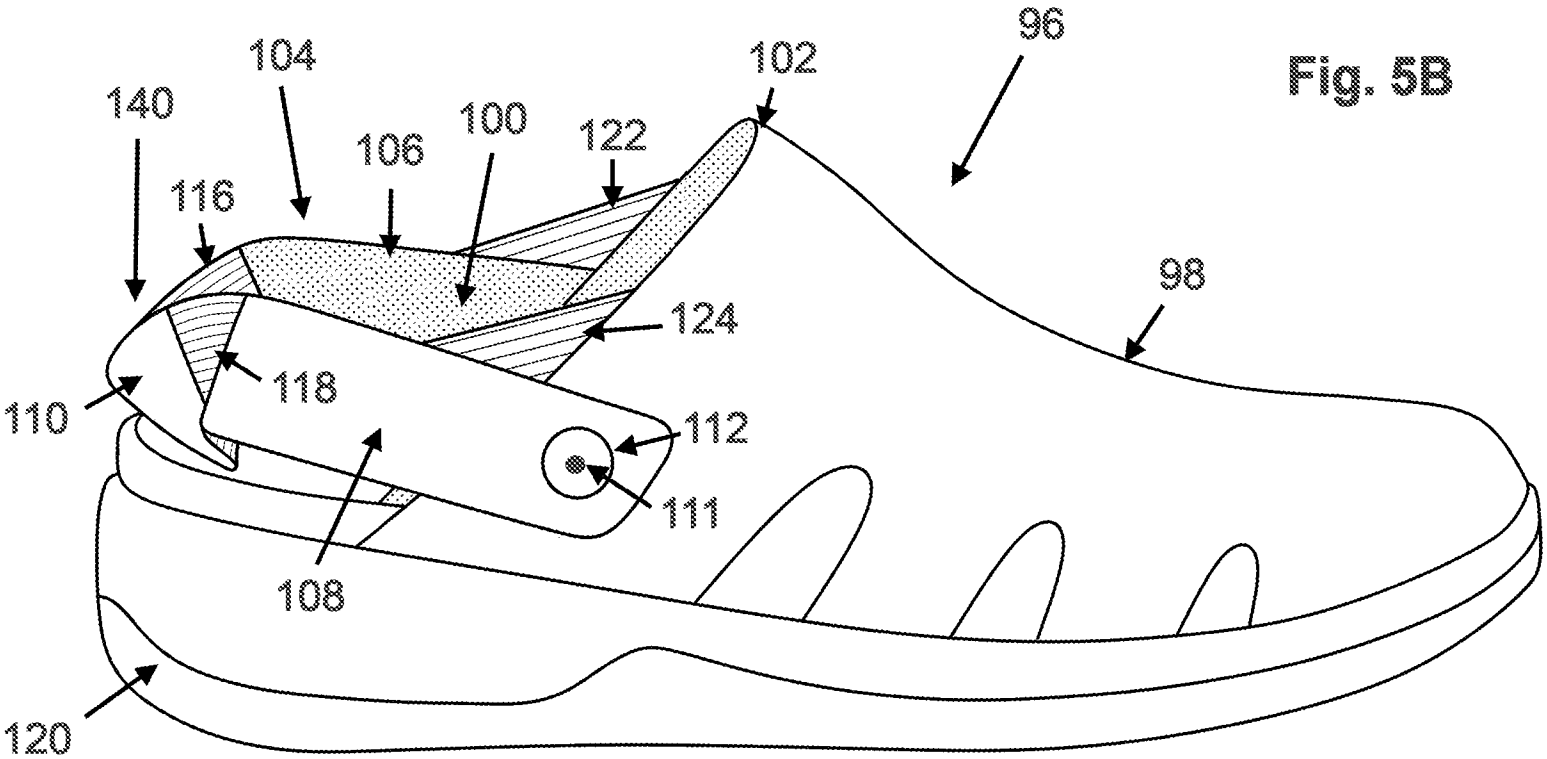
FIG. 5B is a simplified illustration of a side view the closed-toe easy entry sandal with the heel strap depressed.

Reference is now made to FIG. 5A, which according one embodiment is a simplified illustration of a side view of a closed-toe sandal 96, depicting heel strap 104 in an upward position, and to FIG. 5B, which is a simplified illustration of a side view of closed-toe sandal 96 depicting heel strap 104 in a downward position.

As an option, the simplified illustrations of FIG. 5A and FIG. 5B may be viewed in the context of the details of the previous figures. Of course, however, the simplified illustrations of FIG. 5A and FIG. 5B may be viewed in the context of any desired environment. Further, the aforementioned definitions may equally apply to the description below.

As shown in in FIG. 5A and FIG. 5B, sandal 96 may include a sole 120, upper 98, medial anterior elastic member 122, lateral anterior elastic member 124, and sandal opening 100, through which a foot is inserted while putting on the sandal. Sandal opening 100 is defined by posterior area 102 of upper 98 and heel strap 104, shaped to surround a heel of a foot.

FIG. 5A depicts heel strap 104 in its upward position, however, heel strap 104 may pivot downward and upward relative to upper 98 around frontal axis 111, which is the line that runs from the medial side of sandal 96 to the lateral side of the sandal through hinge 112 on the lateral side and a symmetrical hinge on the medial side of sandal 96 (not shown). Lateral strap member 108 may be attached to the lateral part of upper 98 via hinge 112 and medial strap member 106 may be attached to the medial aspect of upper 98 via a medial hinge (not shown).

As shown in FIG. 5A, rear strap member 110 may be curved diagonally upward and backward, providing a sliding surface 126 at the inner side of rear strap member 110. This sliding surface 126 is thus flanged outward from the opening 100 in a yawning fashion to more easily receive the heel of a foot being inserted into the opening 100 and to provide a surface over which the heel can more easily slide into the opening 100 of the sandal 96. Reference is now made to FIG. 5B, which is a simplified illustration of a side view of closed-toe sandal 96 depicting a downward position of heel strap 104 when a downward force 140 is applied on the heel strap while a foot is entering the sandal. Both medial strap member 106 and lateral strap member 108 may pivot downward relative to upper 98, while rear strap member 110 may pivot further downward and backward relative to both medial strap member 106 and lateral strap member 108, thus increasing the size of sandal opening 100 and providing enough space for a foot to slip into sandal 96.

Figure 6:
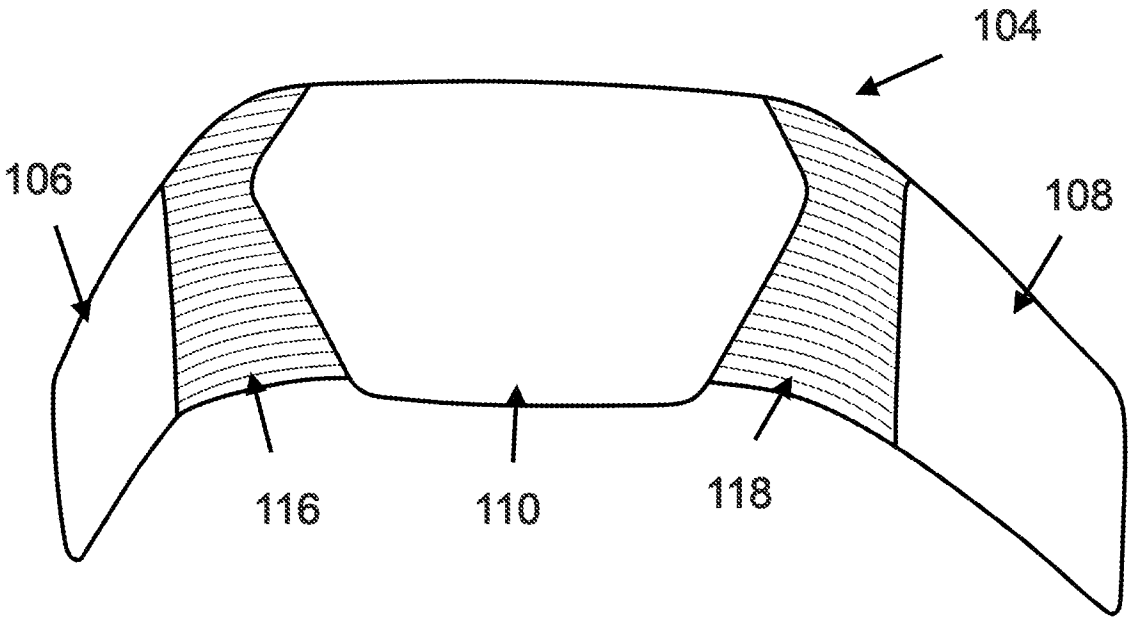
FIG. 6 is a simplified illustration of a rear view of a heel strap that could be utilized in the closed-toe easy entry sandal of FIG. 5B.

Reference is now made to FIG. 6, which is a simplified illustration of a rear view of heel strap 104 according to one embodiment.

As an option, the simplified illustration of FIG. 6 may be viewed in the context of the details of the previous figures. Of course, however, the simplified illustration of FIG. 6 may be viewed in the context of any desired environment. Further, the aforementioned definitions may equally apply to the description below.

Heel strap 104 may include rear strap member 110, medial strap member 106, medial elastic strap member 116, lateral elastic strap member 118, and lateral strap member 108, wherein rear strap member 110 may be attached to the medial strap member 106 via medial elastic strap member 116 and may be attached to the lateral strap member 108 via lateral elastic strap member 118. The medial elastic strap member 116 and lateral elastic strap member 118 maybe attached to the medial strap member 106 and rear strap member 110, or lateral strap member 108 and rear strap member 110, respectively, using any of the afore-mentioned techniques. The medial strap member 116 and lateral strap member 118 may be fabricated from a variety of materials including a rubber strap, Lycra, or Spandex as non-limiting examples.

Rear strap member 110, medial strap member 106 and lateral strap member 108 may be made from a firm material, which prevents a substantial change to their structural shape under forces applied when a foot is sliding into sandal 96.

Figure 7:
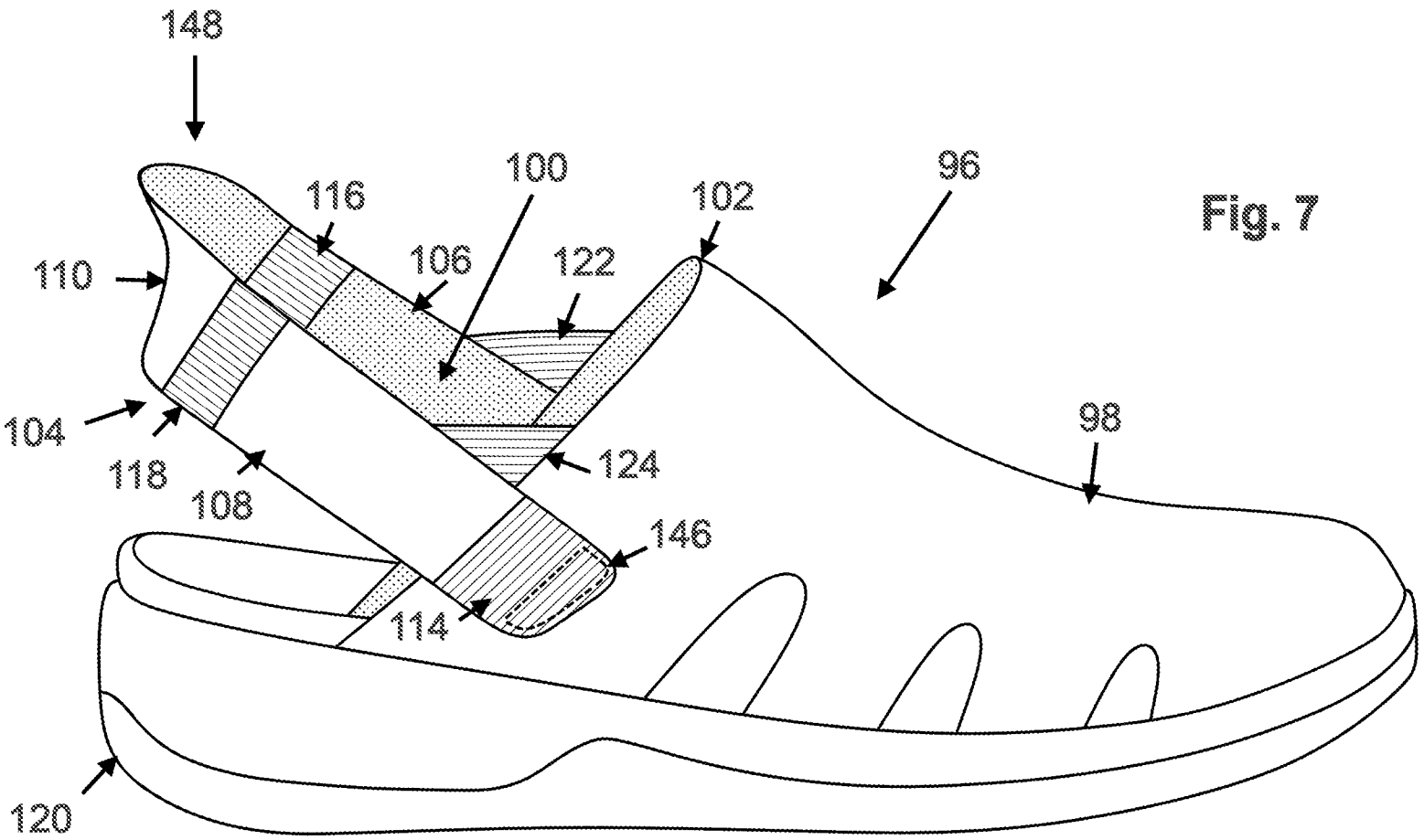
FIG. 7 is a simplified illustration of a side view of another embodiment of closed-toe sandal.

Reference is now made to FIG. 7, which is a simplified illustration of a side view of another embodiment of sandal 96 according to this disclosure, wherein lateral strap member 108 may be attached to the lateral part of upper 98 via elastic member 114 and wherein medial strap member 106 may be attached to the medial aspect of upper 98 via another elastic member (not shown). As illustrated in FIG. 7, the elastic member 114 is attached to the upper 98 of sandal 96 at point or area 146. The remainder portion of elastic member 114 is not attached to the upper 98 and thus, is free to stretch, bend and distort when pressure is applied to the rear strap member 104, thus allowing the rear strap member to move downward under downward force 148, thus increasing the size of opening 100. An clastic member 115 (illustrated in FIG. 8) is similarly structured on the medial side of sandal 96. Elastic members 114 may be fabricated from a variety of materials including a rubber strap, Lycra, or Spandex as non-limiting examples.

Figure 8:
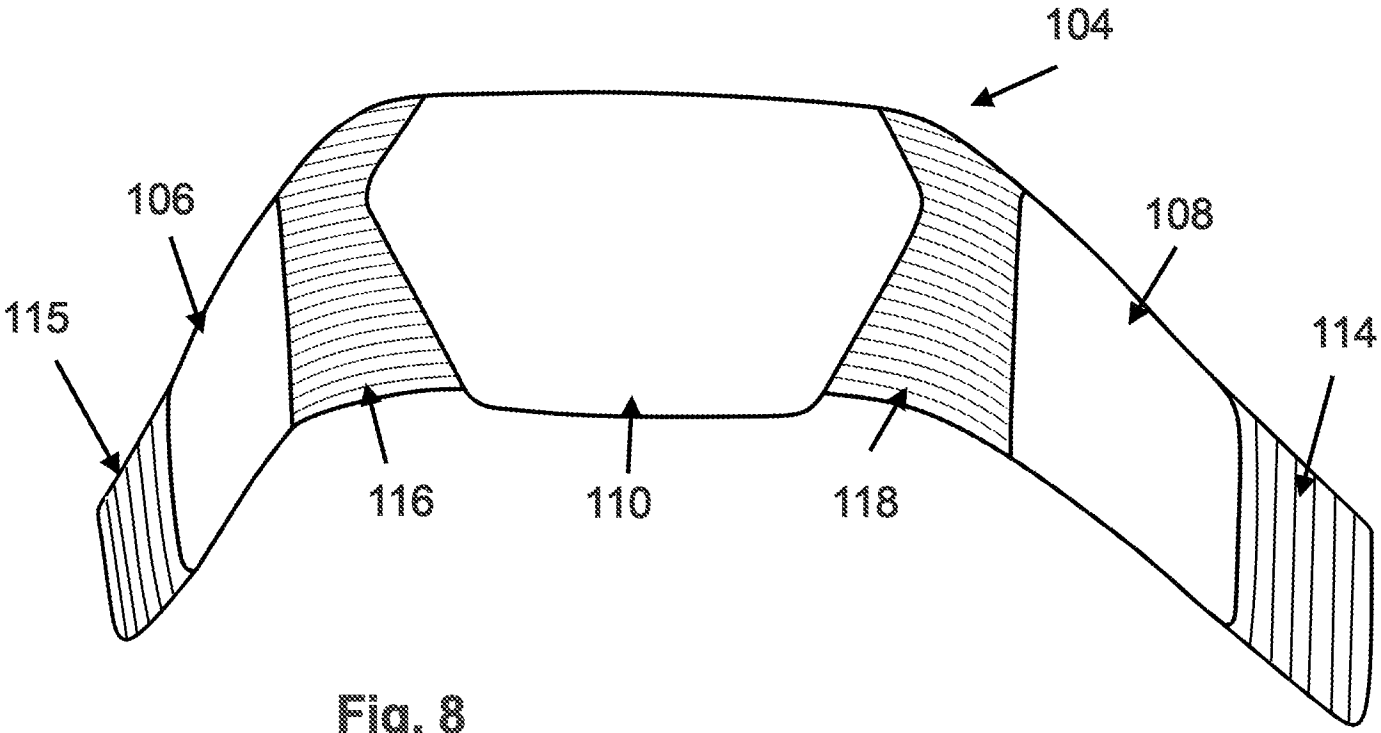
FIG. 8 is a simplified illustration of a rear view of heel strap according to another embodiment.

Reference is now made to FIG. 8, which is a simplified illustration of a rear view of heel strap 104 according to one embodiment. Heel strap 104 may include rear strap member 110, medial strap member 106, medial elastic strap member 116, medial anterior elastic member 115, lateral clastic strap member 118, lateral strap member 108, and anterior lateral elastic member 114. Rear strap member 110 may be attached to medial strap member 106 via medial elastic strap member 116, and wherein rear strap member 110 may be attached to the lateral strap member 108 via lateral elastic strap member 118. According to this embodiment heel strap 104 is allowed to pivot downward and upward relative to upper 98, while stretching and bending elastic member 114 on the lateral side and while stretching and bending clastic member 115 on the medial side. The attachment of the elastic elements and the structure of the elastic elements in this embodiment may be consistent with those described in previous embodiments herein.

Figure 9A:
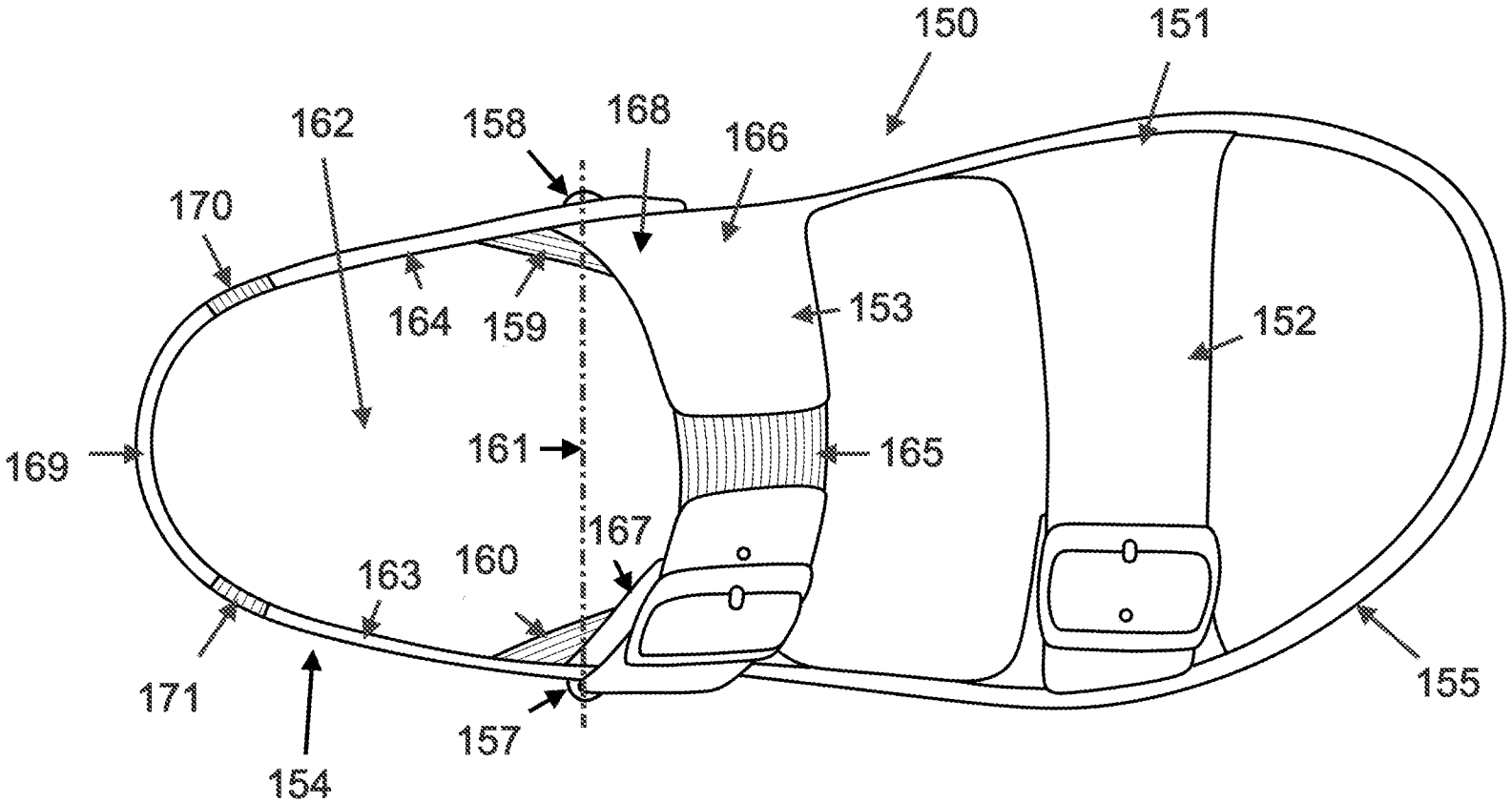
FIG. 9A is a simplified illustration of a lateral view of another embodiment of an easy entry sandal.
Figure 9B:
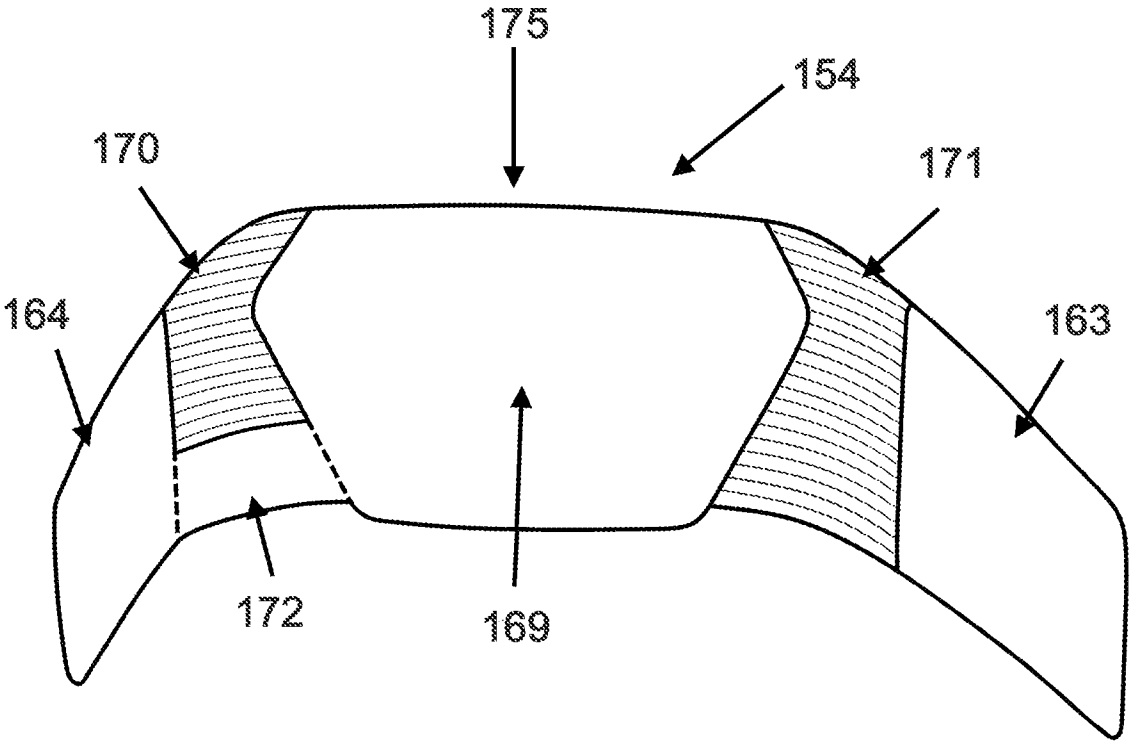
FIG. 9B is a simplified illustration of a rear view strap the easy entry sandal of FIG. 9A.

Reference is now made to FIG. 9A, which is a simplified illustration of a top view of a sandal 150, and to FIG. 9B, which is a simplified illustration of a rear view of strap 154 of sandal 150. According to one embodiment heel strap 154 is defined by anterior lateral heel strap member 163, anterior medial heel strap member 164, and rear heel strap member 169, wherein the rear heel strap member 169 is attached to the lateral heel strap member 163 by posterior lateral elastic strap 171, and wherein rear heel strap member 169 is attached to medial heel strap member 164 by both posterior medial elastic member 170 and posterior medial non-elastic member 172. Posterior medial heel strap member 172 may be positioned below posterior medial elastic member 170 and may reinforce the medial aspect of heel strap 154, thus limiting the amount of rotation and pivoting of rear heel strap member 169.

According to one embodiment, rear heel strap member 169, anterior lateral heel strap member 163, anterior medial heel strap member 164, and posterior medial heel strap member 172 are made from a firm material, preventing said heel strap members from substantially changing their shape under forces applied when a foot is inserted into the sandal opening.

According to another embodiment medial posterior heel strap member 172 is made of softer material than anterior medial heel strap member 164, but firmer than posterior medial elastic member 170.

As shown in FIG. 9A, heel strap 154 may be coupled to upper 151 with pivoting articles, such as hinge 157 on the lateral side and hinge 158 on the medial side. Heel strap 154 may be additionally connected to upper 151 with medial anterior elastic member 159, and lateral anterior elastic member 160.

Figure 9C:
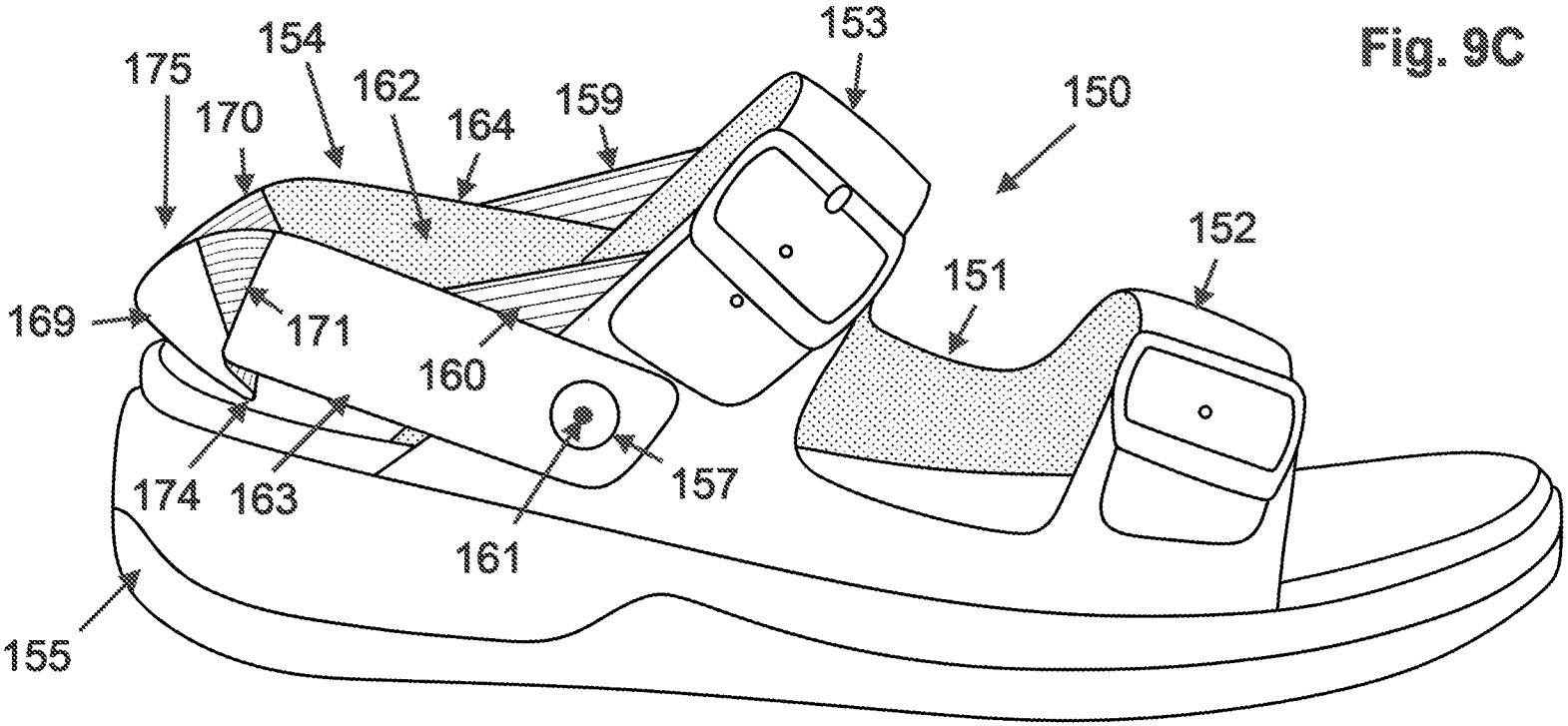
FIG. 9C illustrates the movement of the strap members of FIG. 9A to accommodate a foot being inserted.

According to one embodiment shown in FIG. 9C, by applying a downward force 175 on heel strap 154, both medial strap member 164 and lateral strap member 163 may pivot downward relative to upper 152 and sole 155 along the general direction of the longitudinal plane, wherein rear strap member 169 may pivot downward and backward relative to both medial heel strap member 164 and lateral heel strap member 163. To take the sandal off, a force, such as force 175 may be applied on rear heel strap member 169, causing lateral heel strap member 163 and medial heel strap member 164 to pivot downward toward the rear part of sole 155 and causing rear heel strap member 169 to rotate downward and backward relative to both medial strap member 164 and lateral strap member 163, thus increasing the size of sandal opening 162. As depicted in FIG. 9C, excessive pivoting of rear heel strap member 169 might move forward the bottom part 174 of rear heel strap member 169, which might decrease the sandal opening 162 and may press against the posterior surface of a heel of a foot, which may also prevent a foot from sliding out of the sandal. According to one embodiment, posterior medial heel strap member 172, shown in FIG. 9B, reinforces the medial aspect of heel strap 154, and also may be limiting the downward and backward pivoting of rear heel strap member 169, thus eliminating the reduction of sandal opening 162.

It is expected that during the life of this patent various sandal technologies and materials will be developed and the scope of the terms herein, particularly of the terms "sandal" and "shoe" are intended to include all such new technologies and materials a priori.

Additional objects, advantages, and novel features of the embodiments described herein will become apparent to one ordinarily skilled in the art upon examination of the examples provided herein, which are not intended to be limiting. Additionally, each of the various embodiments and aspects of embodiments as delineated hereinabove and as claimed in the claims section below finds experimental support in the provided examples and exemplary embodiments.

It is appreciated that certain features of the system and method described herein, which are, for clarity, described in the context of separate embodiments, may also be provided in combination in a single embodiment. Conversely, various features, which are, for brevity, described in the context of a single embodiment, may also be provided separately or in any suitable sub-combination.

Although the system and methods have been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent, or patent application was specifically and individually indicated to be incorporated herein by reference. In addition, citation, or identification of any reference in this application shall not be construed as an admission that such reference is available as prior art.

What is claimed is:

1. A sandal comprising: a sole,
an upper having a front member,
a heel strap;
a medial anterior elastic member, and
a lateral anterior elastic member,
wherein the upper comprises a sandal opening defined by the front member of the upper and the heel strap, shaped to surround a heel of a foot;
a void defined by and existing between said heel strap and a rear surface of the sole,
wherein the heel strap comprises at least five members, including a rear strap member, a medial strap member, a medial elastic strap member, a lateral elastic strap member, and a lateral strap member,
wherein the rear strap member, the medial strap member and the lateral strap member are made from a firm material, preventing said strap members from substantially changing their shape under forces applied on the heel strap when a foot is inserted into the sandal opening;
wherein the rear strap member is attached to the medial strap member via the medial elastic strap member, and wherein the rear strap member is attached to the lateral strap member via the lateral elastic strap member;
wherein the heel strap is allowed to pivot downward and upward relative to the upper and the sole;
wherein the anterior medial elastic member is attached on one end to the medial strap member, and on its other end, to a medial side of the upper, and wherein the anterior lateral elastic member is attached on one end to the lateral strap member, and on its other end, to a lateral side of the upper;
wherein by applying a downward force on the heel strap, both the medial strap member and the lateral strap member are allowed to pivot downward relative to the upper, and wherein the rear strap member is allowed to pivot downward and backward relative to both the medial strap member and the lateral strap member;
wherein when the heel strap is pivoted downward, the anterior medial elastic member and the anterior lateral elastic member are stretched, and wherein the lateral elastic strap member and the medial elastic strap member are bent and stretched; and
wherein once the downward force is removed, the stretched anterior lateral elastic member draws the lateral strap member to pivot upward, the stretched anterior medial elastic member draws the medial strap member to pivot upward, and wherein both the stretched lateral elastic strap member and the stretched medial elastic strap member draw the rear strap member to pivot upward and forward.

2. A sandal according to claim 1, wherein the lateral strap member is attached to the lateral part of the upper via a hinge and wherein the medial strap member is attached to the medial member of the upper via a hinge.

3. A sandal according to claim 1, wherein both the medial and lateral parts of the upper proximate to the hinge area are made of a firm material and thus, preventing the medial and lateral parts of the upper from flexing or changing their shape under forces applied by a foot while entering the sandal.

4. A sandal according to claim 1, wherein the front part of the collar includes an element that stretches.

5. A sandal according to claim 1, wherein the front part of the collar comprises an elastic member.

6. A sandal according to claim 1, wherein the top part of the rear strap member is extending diagonally upward and backward.

7. A sandal according to claim 1, wherein the front part of the sandal opening comprises a strap.

8. A sandal comprising:

a sole, an upper having a front member, a heel strap, a lateral torsion spring, a medial torsion spring, wherein the upper comprises a sandal opening defined by the front member and the heel strap, shaped to surround a heel of a foot;

a void defined by and existing between said heel strap and a rear surface of the sole, wherein the heel strap comprises at least five members, including a rear strap member, a medial strap member, a medial elastic strap member, a lateral elastic strap member, and a lateral strap member, wherein the rear strap member, the medial strap member and the lateral strap member are made from a firm material, preventing said strap members from substantially changing their shape under forces applied on the heel strap when a foot is inserted into the sandal opening;

wherein the rear strap member is attached to the medial strap member via the medial elastic strap member, and wherein the rear strap member is attached to the lateral strap member via the lateral elastic strap member;

wherein the heel strap is allowed to pivot downward and upward relative to the upper and the sole;

wherein the medial torsion spring is attached on one end to the medial strap member, and on its other end, to either the medial side of the upper, to the medial side of the sole, or to both the medial side of the upper and the medial side of the sole;

wherein the lateral torsion spring is attached on one end to the lateral strap member, and on its other end, to either the lateral side of the upper, to the lateral side of the sole, or to both the lateral side of the upper and the lateral side of the sole;

wherein by applying a downward force on the heel strap, both the medial strap member and the lateral strap member are allowed to pivot downward relative to the upper, and wherein the rear strap member is allowed to pivot downward and backward relative to both the medial strap member and the lateral strap member;

wherein when the heel strap is pivoted downward, the medial and lateral torsion springs store potential energy, and wherein the lateral elastic strap member and the medial elastic strap member are bent and stretched; and wherein once the downward force is removed, the lateral torsion spring draws the lateral strap member to pivot upward, the medial torsion spring draws the medial strap member to pivot upward, and wherein both the stretched lateral elastic strap member and the stretched medial elastic strap member draw the rear strap member to pivot upward and forward.

9. A sandal according to claim 8, wherein the lateral strap member is attached to the lateral part of the upper via a hinge and wherein the medial strap member is attached to the medial member of the upper via a hinge.

10. A sandal according to claim 8, wherein both the medial and lateral parts of the upper proximate to the hinge area are made of a firm material and thus, preventing the medial and lateral parts of the upper from flexing or changing their shape under forces applied by a foot while entering the sandal.

11. A sandal according to claim 8, wherein the front part of the collar includes an element that stretches.

12. A sandal according to claim 8, wherein the front part of the collar comprises an elastic member.

13. A sandal according to claim 8, wherein the top part of the rear strap member is extending diagonally upward and backward.

14. A sandal according to claim 8, wherein the front part of the sandal opening comprises a strap.

15. A sandal comprising:

a sole, an upper having a front member and a heel strap, wherein the upper comprises a sandal opening defined by the upper's front member and the heel strap, shaped to generally surround a heel of a foot, wherein the heel strap comprises a rear heel strap member, a lateral heel strap member, and a medial heel strap member, wherein the rear heel strap member is attached to the lateral heel strap member by a lateral elastic strap, and wherein the rear heel strap member is attached to the medial heel strap member by both a medial elastic member and a non-elastic member, wherein the rear heel strap member, the medial heel strap member, and the anterior portion of the lateral heel strap member are made from a firm material, preventing said heel strap members from substantially changing their shape under a force applied on the heel strap when a foot is inserted into the sandal opening, a medial anterior elastic member, which is attached on one end to the medial strap member, and on its other end to a medial side of the upper, a lateral anterior elastic member, which is attached on one end to the lateral strap member, and on its other end to a lateral side of the upper;

wherein the heel strap is allowed to pivot relative to the upper and the sole along the general direction of the longitudinal plane, wherein the rear member of the heel strap is allowed to pivot downward and backward along the general direction of the longitudinal plane relative to both the medial heel strap member and the lateral heel strap member, wherein by applying a downward force on the heel strap, both the medial heel strap member and the lateral strap member are allowed to pivot downward relative to the upper and the sole, and wherein the rear heel strap member is allowed to pivot downward and backward relative to both the medial heel strap member and the lateral heel strap member, wherein when the heel strap is pivoted downward, the anterior medial elastic member and the anterior lateral elastic member are stretched, while the lateral elastic strap member and the medial elastic strap member are bent and stretched, and wherein once the downward force is removed, the stretched anterior lateral elastic member draws the lateral heel strap member to pivot upward, the stretched anterior medial elastic member draws the medial heel strap member to pivot upward, and wherein both the stretched lateral elastic strap member and the stretched medial elastic strap member draw the rear heel strap member to pivot upward and forward.

16. A sandal according to claim 15, wherein the lateral strap member is attached to the lateral part of the upper via a hinge and wherein the medial strap member is attached to the medial member of the upper via a hinge.

17. A sandal according to claim 15, wherein both the medial and lateral parts of the upper proximate to the hinge area are made of a firm material and thus, preventing the medial and lateral parts of the upper from flexing or changing their shape under forces applied by a foot while entering the sandal.

18. A sandal according to claim 15, wherein the front part of the collar includes an element that stretches.

19. A sandal according to claim 15, wherein the front part of the collar comprises an elastic member.

20. A sandal according to claim 15, wherein the top part of the rear strap member is extending diagonally upward and backward.

21. A sandal according to claim 15, wherein the front part of the sandal opening comprises a strap.

* * * * *